US006953387B2

(12) United States Patent
Greenslet et al.

(10) Patent No.: US 6,953,387 B2
(45) Date of Patent: Oct. 11, 2005

(54) METHOD AND APPARATUS FOR MEASURING FLOW RATE THROUGH AND POLISHING A WORKPIECE ORIFICE

(75) Inventors: John M. Greenslet, Saitama (JP); Lawrence J. Rhoades, Pittsburgh, PA (US)

(73) Assignee: Extrude Hone Corporation, Irwin, PA (US)

( * ) Notice: Subject to any disclaimer, the term of this patent is extended or adjusted under 35 U.S.C. 154(b) by 0 days.

(21) Appl. No.: 10/988,176

(22) Filed: Nov. 12, 2004

(65) Prior Publication Data

US 2005/0118931 A1 Jun. 2, 2005

Related U.S. Application Data

(63) Continuation-in-part of application No. 10/668,590, filed on Sep. 23, 2003, now abandoned.

(51) Int. Cl.[7] ..... B24B 1/00
(52) U.S. Cl. ..... 451/36; 451/8; 451/559
(58) Field of Search ..... 451/36, 37, 40, 451/64, 114, 60, 61, 430, 559, 8; 73/195–197

(56) References Cited

U.S. PATENT DOCUMENTS

| | | | |
|---|---|---|---|
| 5,054,247 | A | 10/1991 | Rhoades et al. |
| 5,076,027 | A | 12/1991 | Rhoades |
| 5,807,163 | A | 9/1998 | Perry |
| 6,306,011 | B1 | 10/2001 | Perry et al. |
| 6,500,050 | B2 | 12/2002 | Walsh et al. |

*Primary Examiner*—Dung Van Nguyen
(74) *Attorney, Agent, or Firm*—The Webb Law Firm

(57) ABSTRACT

A method and apparatus for comparing the flow rate through an orifice within a master part with the orifice within a workpiece by subjecting each orifice to an identical fluid at an identical temperature, under an identical pressure, and comparing the downstream pressures of the fluid exiting these orifices when the upstream pressure is constant or comparing the upstream pressure when the downstream pressure is constant. For purely measurement purposes, the fluid may be a non-abrasive media, however, in the event the workpiece orifice must be machined, it is possible to introduce a flowable abrasive media, and pass this media through the orifices until the desired pressure difference is achieved. With additional flow characteristics of the master part, it is also possible to calculate the flow rate through the workpiece orifice using only the pressure differential at the exits of the workpiece and the master part.

26 Claims, 5 Drawing Sheets

METHOD AND APPARATUS FOR MEASURING FLOW RATE THROUGH AND POLISHING A WORKPIECE ORIFICE

This application is a CIP of Ser. No. 10/668,590 filed Sep. 23, 2003 now abandoned.

BACKGROUND OF THE INVENTION

1. Field of the Invention

The invention relates to a method and apparatus for determining whether or not the flow rate through one or more orifices in a workpiece are within permissible tolerance when compared to the flow rate through one or more matching orifices in a master part. This determination is based upon characteristics of fluid flow passing through the orifices in the workpiece and in the master part. Additionally, the subject invention is directed to a method and apparatus for machining the one or more orifices in a workpiece so that the geometry better conforms to the geometry of the matching one or more orifices of the master part. Finally, the invention relates to a method of determining the flow rate through the one or more orifices of the workpiece.

2. Description of Related Art

Components such as fuel injectors and orifice plates typically include small orifices with flow rates that must be precisely controlled to very small tolerances. Manufacturers of such components generally make use of a measurement device, such as a flow bench, which forces a calibration fluid through the component orifices at a precise pressure and then measures the flow rate through the component orifices. This flow measurement may be made by a flow meter based on a wide range of technologies, including Coriolis meters, positive displacement meters such as gear and piston pumps, turbine meters, and vortex shedding flow meters.

FIG. 1 is prior art and shows a schematic of a typical flow bench 300 used for measuring the flow rate through a workpiece 310 having one or more orifices (not shown) extending therein. Calibration fluid from a reservoir 315 is forced by a pump 325 past a heat exchanger 330 and a filter 335 and then forced under pressure through at least one orifice (not shown) in the workpiece 310. The flow rate downstream of the workpiece 310 is measured directly by a flow meter 340. There must be a minimum amount of downstream pressure of the fluid past the workpiece 310 to drive the fluid through the flow meter 340. Upon exiting the flow meter 340, the fluid is re-introduced into the reservoir 315.

However, methods using flow meters often create bottlenecks in the overall manufacturing process due to lengthy measurement times. Since the usual measurement method is to measure the flow rate through a part at a given pressure, then depending on the means of supplying pressurized calibration fluid to the part, it may take several seconds to achieve a desired pressure and then to stabilize the fluid flow at that pressure, at which time flow measurements may be taken. Moreover, the flow measurement devices often require long measurement times to deliver a stable measurement. As a result, using conventional techniques, measurement times of 25 to 60 seconds or more are often required to determine whether or not a part is within a prescribed flow tolerance range.

Use of a conventional flow bench gives the operator an absolute value for the flow rate, whether it be mass flow rate or volume flow rate, through a part at the measurement pressure. If the flow rate is within tolerance, the part passes. If the flow rate is below the target, the part may be sent back for rework. If rework is not possible, the part would be scrapped. If the flow rate through the part is too high, the part is usually treated as scrap.

There is a need to produce a gauge similar to a go/no-go gauge used for thread, hole and other machining operations for use in checking the flow rate through an orifice. Such a gauge would simply indicate whether a part was in tolerance or, if out of tolerance, indicate the direction in which the discrepancy occurred. Such a determination would be possible without having to produce a numerical value of the flow rate. Because an actual value of the flow rate is not required, it would be possible to employ faster techniques.

SUMMARY OF THE INVENTION

In one embodiment, the invention is directed to a method of comparing the flow rate through one or more orifices in a workpiece, wherein each workpiece orifice is formed to resemble an orifice in a master part and wherein the flow rate through the one or more workpiece orifices is compared against the flow rate through the one or more orifices in the master part to determine whether or not the flow rate through the one or more workpiece orifices is within tolerance relative to the flow rate through the one or more master orifices. The method is comprised of the steps of: (a) forcing calibration fluid from a reservoir under pressure through the one or more orifices in a master part; (b) forcing calibration fluid from the same reservoir under the same pressure through the one or more orifices in the workpiece; (c) controlling the flow of fluid to provide an equal flow rate through the one or more orifices in the workpiece and the one or more orifices in the master part; and (d) comparing the fluid pressure downstream of each the workpiece and the master part to determine whether or not the pressure differential is within a predetermined range indicating whether or not the flow rate through the one or more orifices in the workpiece are within tolerance. This method may also be adapted to compare the one or more orifices of each of a multiple of workpieces.

In another embodiment, the invention is directed to a similar method, however, the pressure downstream of the workpieces is kept uniform, and the calibration fluid pressure is compared upstream of each of the workpiece and the master part to determine whether or not the pressure differential is within a predetermined range.

In another embodiment, the invention is directed to a method of comparing the flow rate through one or more orifices in a workpiece, wherein the one or more workpiece orifices are formed to resemble one or more orifices in a master part wherein the flow rate through the workpiece is compared with the flow rate through the master part to determine whether or not the flow rate through the one or more workpiece orifices is within tolerance relative to the flow rate through the one or more master part orifices and machining the one or more workpiece orifices using abrasive flow media comprising the steps of: (a) extruding flowable abrasive media from a reservoir under pressure through the one or more orifices in the master part, wherein the master part material is impervious to and unaffected by the abrasive flow media; (b) extruding flowable abrasive media from a reservoir under pressure through the one or more orifices in the workpiece; wherein prior to the extrusion the one or more workpiece orifices restrict flow more than the one or more master part orifices; (c) controlling the flow of media to provide an equal flow rate through each of the one or more workpiece orifices and through the one or more master part orifices; (d) comparing the media pressure downstream of the workpiece and the master part; and (e) stopping the extrusion through the one or more workpiece orifices when the pressure differential of the media exiting the one or more workpiece orifices and the media exiting the one or more master orifices is between predetermined limits. This method may also be adapted to compare the flow rate through a number of different workpieces and control the extrusion process to modify the one or more orifices associated with each workpiece.

In another embodiment, the invention is directed to a similar method, however, the pressure downstream of the workpieces is kept uniform, and the flowable abrasive media pressure is compared upstream of each of the workpiece and the master part to determine whether or not the pressure differential is within a predetermined range.

In another embodiment, the invention is directed to a method of determining the flow rate through a workpiece having one or more orifices formed to resemble one or more orifices in a master part comprising the steps of: a) forcing calibration fluid from a reservoir under pressure through the one or more orifices in the master part; b) forcing calibration fluid from the same reservoir under the same pressure through the one or more orifices in the workpiece; c) controlling the flow of fluid to provide an equal flow rate through each of the workpiece and the master part; d) comparing the fluid pressure downstream of the master part and the workpiece to determine a pressure difference; and e) calculating the flow rate through the workpiece using predetermined flow rate data about the master part, the difference in downstream pressure between the workpiece and the master part, and the mathematical relationship between the orifices in the master part and the orifices in the workpiece.

In another embodiment, the invention is directed to a similar method, however, the flow rate is calculated through the workpiece using predetermined flow rate data about the master part, the difference in upstream pressure between the workpiece and the master part while the downstream pressures are kept uniform, and the mathematical relationship between the orifices in the master part and the orifices in the workpiece.

In yet another embodiment, the invention is directed to an apparatus for comparing the flow rate through one or more orifices in a workpiece with the flow rate through one or more orifices in a master part, wherein the one or more workpiece orifices are formed to resemble one or more orifices in the master part, wherein the flow rate is compared to determine whether or not the flow rate through the one or more orifices in the workpiece are within tolerance relative to the flow rate through the one or more orifices in the master part, wherein the apparatus is comprised of: (a) a reservoir for supplying calibration fluid under pressure to the one or more orifices in the master part and to the one or more orifices of the workpiece; (b) a flow controller associated with the workpiece and the master part such that the flow of fluid from the reservoir through the one or more orifices in each of the workpiece and the master part is equal; and (c) a measurement device for comparing the pressure downstream of the master orifice and the pressure downstream of the workpiece, wherein when the pressure differential downstream of the workpiece and downstream of the master part is within a predetermined limit, the orifices in that workpiece are deemed to be within tolerance.

In another embodiment, the invention is directed to a similar apparatus, however the downstream pressures are kept uniform, and the measurement device compares the pressure upstream of the master orifice and the pressure upstream of the workpiece.

DETAILED DESCRIPTION OF THE INVENTION

Figure 1:
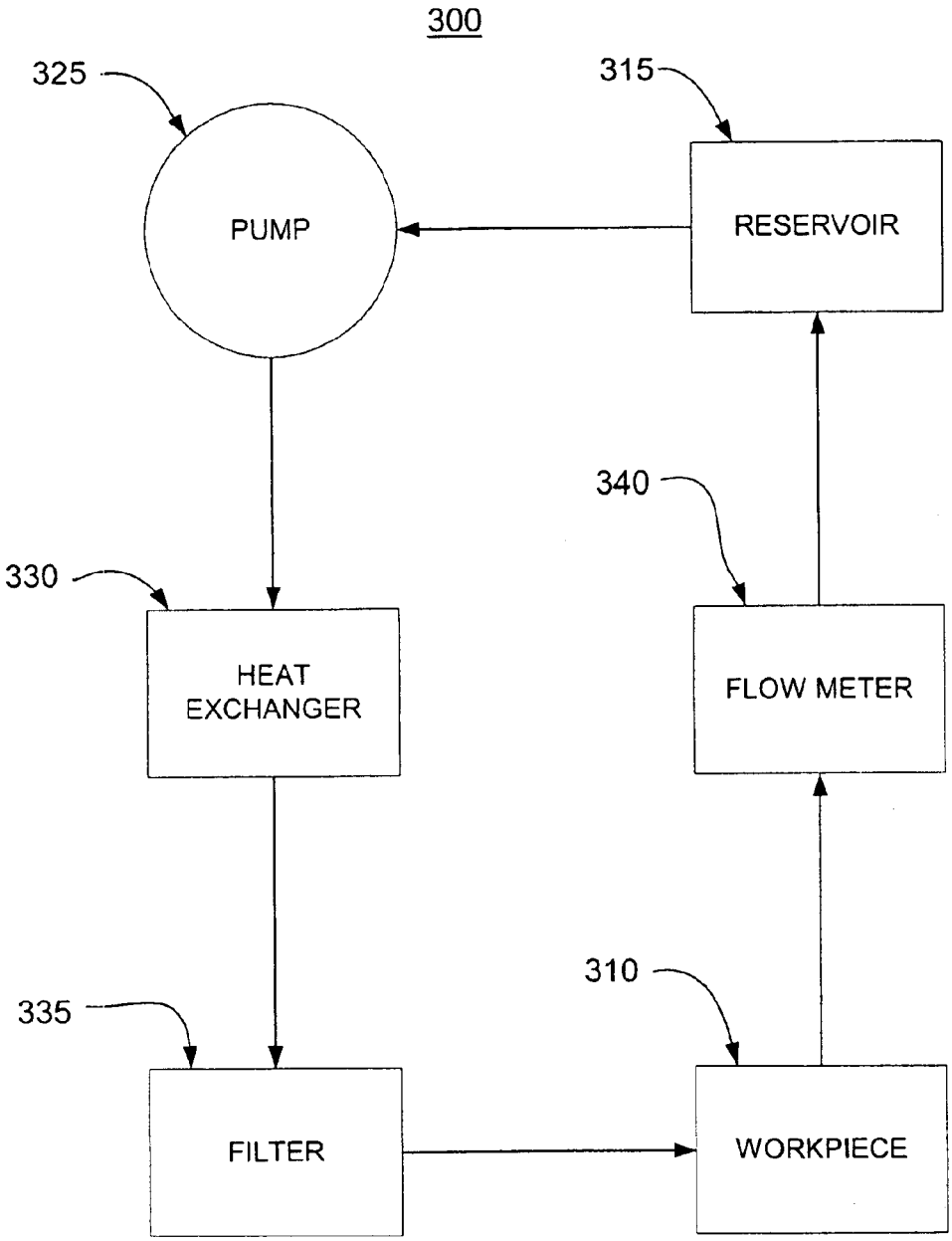
FIG. 1 PRIOR ART
FIG. 1 is prior art and is a schematic of a typical flow bench arrangement.

The flow rate through an orifice is a function of the pressure drop across the orifice, the geometry of the orifice, and the properties of the fluid flowing through the orifice. In general, a fluid under uniform pressure will pass through two orifices that have identical geometries at the same flow rate, whether mass flow rate or volumetric flow rate. In the same way, if fluid under uniform upstream pressure passes through each of these two identical orifices, the pressure drop past the orifices will be identical.

A typical workpiece may be a nozzle having a plurality of radially oriented orifices to disperse fluid travelling therethrough. A typical workpiece may also be a nozzle having a single orifice. A typical workpiece may also be an orifice plate made up of a simple flat plate having a single orifice extending therethrough. For purposes of discussion herein, the workpiece and the associated master part will have a single orifice with the understanding that each the workpiece and the master part may have one or more orifices. In each case, however, there will be a direct one-to-one correlation between the orifices in the workpiece and the orifices in the master part.

In accordance with the subject invention a uniform upstream pressure is introduced through an orifice in a master part and through an orifice in a workpiece such that if the flow rate is the same through each the master part and the workpiece, then the geometry of the workpiece orifices in the workpiece is assumed to be within tolerance of the geometry of the orifice in the master part if the downstream pressures are equal. The pressurized fluid is provided from a common source, and therefore it can be assumed that the viscosity and temperature are equal. As a result, when the differential pressure of fluid downstream of the master part and downstream of the workpiece is equal to zero, then the downstream pressures are equal and the geometries of the orifices in each the workpiece and the master part are assumed to be equivalent.

As will be illustrated, the subject invention may be used to quickly compare the orifice in a workpiece to a known orifice in a master part to determine if the workpiece orifice is within specification limits of the orifice manufacturer. If the pressure downstream of the master part is greater than the pressure downstream of the workpiece, this indicates that the orifice in the workpiece presents a greater flow obstruction than the orifice of the master part. If the pressure downstream of the master part is less than the pressure downstream of the workpiece, then the workpiece orifice presents a lesser flow obstruction.

As will be illustrated, the subject invention has a number of advantages over the prior art method of flow measurement which, as mentioned, is typically performed on a flow stand that measures one part at a time in 25 seconds or more. The measurement performed in accordance with the subject invention is one of pressure, and pressure can be measured very quickly compared to flow rate. As a result, the apparatus in accordance with the subject invention can check a part in 10 seconds or less. Furthermore, the capability of the apparatus in accordance with the subject invention can be expanded by simply adding multiple receiving cylinders to check multiple parts simultaneously.

Because the pressurized fluid comes from a common source, there is self-compensation for the effects of the fluid properties and the temperatures since the characteristics of the fluid entering the master part orifice and the workpiece orifice are identical. Moreover, when fluid to each orifice is provided from a common reservoir, the upstream pressure does not have to be tightly controlled for a simple "go/no-go" comparative result.

Under the assumption that the actual flow rate through the master orifice will be known, and with knowledge of the differential pressure measurement, it is possible to calibrate the subject apparatus to provide true flow measurements within a certain range between the orifice of a master part and the orifice of one or more workpieces.

Figure 2:
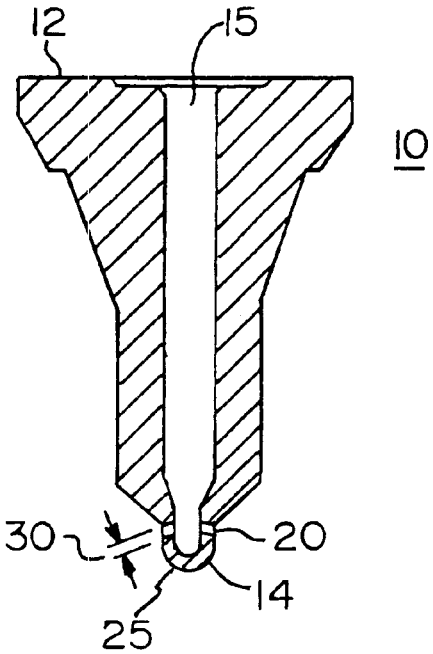
FIG. 2 PRIOR ART
FIG. 2 is a cross-sectional view of a prior art fuel injector metering nozzle.

FIG. 2 illustrates a cross-sectional view of a workpiece 10 in the form of a fuel injector spray nozzle having a passageway 15 extending from one end 12 and intersecting with orifices 20, which pass through the opposing end 14 of the workpiece 10. Such a typical nozzle 10 could have an oil flow at 2031 psig (14 MPa) of 51.8 $in^3$/min (850 cc/min) through seven radially extending orifices 20 disposed at equal angles about the periphery of the tip 25. The inside diameter 30 of each orifice 20 may be approximately 0.0059 inch (0.149 mm).

While a typical workpiece 10 is comprised of a passageway 15 with orifices 20, it should be appreciated that pressure drop for fluid travelling through the workpiece 10 will be caused by flow through the passageway 15 and flow through the orifices 20. However, the passageway 15 typically has a much larger diameter relative to the orifices 20 and as a result the passageway 15 is only a minor source of pressure drop relative to the pressure drop through the orifices 20. For that reason the following discussion will be directed to the pressure drop through the orifices 20 and will not further address the pressure drop through the passageway 15.

Figure 3:
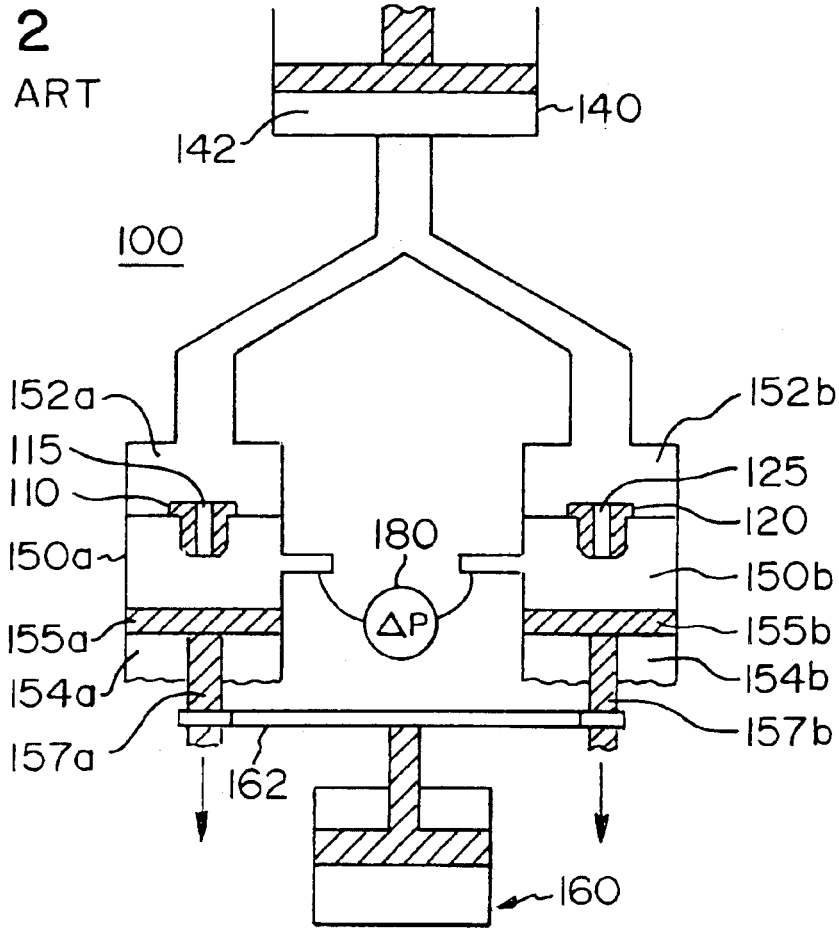
FIG. 3 is a schematic drawing of one embodiment of an apparatus in accordance with the subject invention.

For simplicity, while FIG. 2 illustrates a workpiece 10 having multiple orifices 20, the master part 110 and the workpiece 120 in FIG. 3 will be illustrated with only a single orifice extending along the entire length of the master part 110 and the workpiece 120. As previously mentioned, the discussion will be directed to a workpiece having a single orifice with the understanding that the subject invention is applicable to workpieces having multiple orifices as well. The master part 110 has a master orifice 115 extending therethrough, while the workpiece 120 has a workpiece orifice 125 extending therethrough. The apparatus 100 has a reservoir 140 containing therein a fluid 142 such as a low viscosity oil. The fluid 142 within the reservoir 140 is in direct communication with the master part 110 and the workpiece 120. It is particularly important that the flow conditions of the fluid from the reservoir 140 to each of the master part 110 and workpiece 120 are essentially identical. This may be accomplished by making certain that the distance the fluid travels from the reservoir 140 to each of the master part 110 and workpiece 120 is the same, inasmuch as the tubing or piping utilized transporting the fluid from the reservoir 140 to each of the master part 110 and workpiece 120 is identical so that pressure drop and heat transfer along the piping is identical for each orifice. In such a fashion the entry conditions of the fluid 142 at the entrance to both the orifice 115 of the master part 110 and the orifice 125 of the workpiece 120 are identical. This parameter is critical because it ensures that the pressure of the fluid entering both of these orifices is identical. A fundamental assumption of the subject invention is that identical fluid under identical pressure passing through each the master orifice 115 and the workpiece 125 will encounter an identical pressure drop only if the geometry of the master orifice 115 and workpiece orifice 125 are identical. Without fluid entering each of these orifices at the identical pressure, then the determination of the pressure drop across each orifice becomes more complicated.

Because the fluid in the reservoir supplies both of the orifices and only the pressure at the outlet of each of the orifices provides the critical measurement, then the fluid properties and the temperature of the fluid at the orifice inlets may vary, since the same variation will be experienced by both of the orifices. However, it is critical that the flow rate through each of the orifices is identical.

Figure 4:
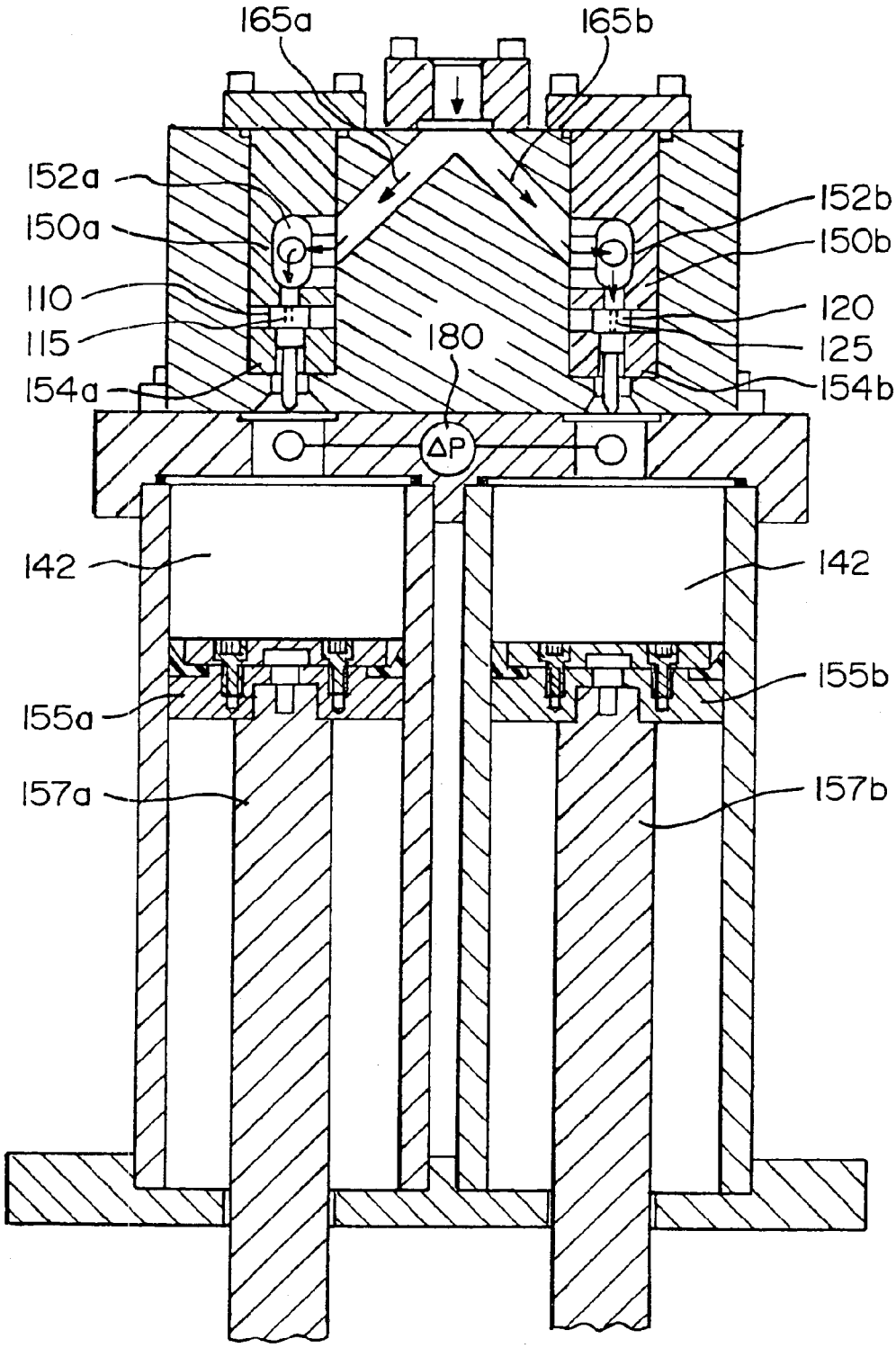
FIG. 4 is a cross-sectional view of the apparatus represented in the schematic drawing of FIG. 3.
Figure 5:
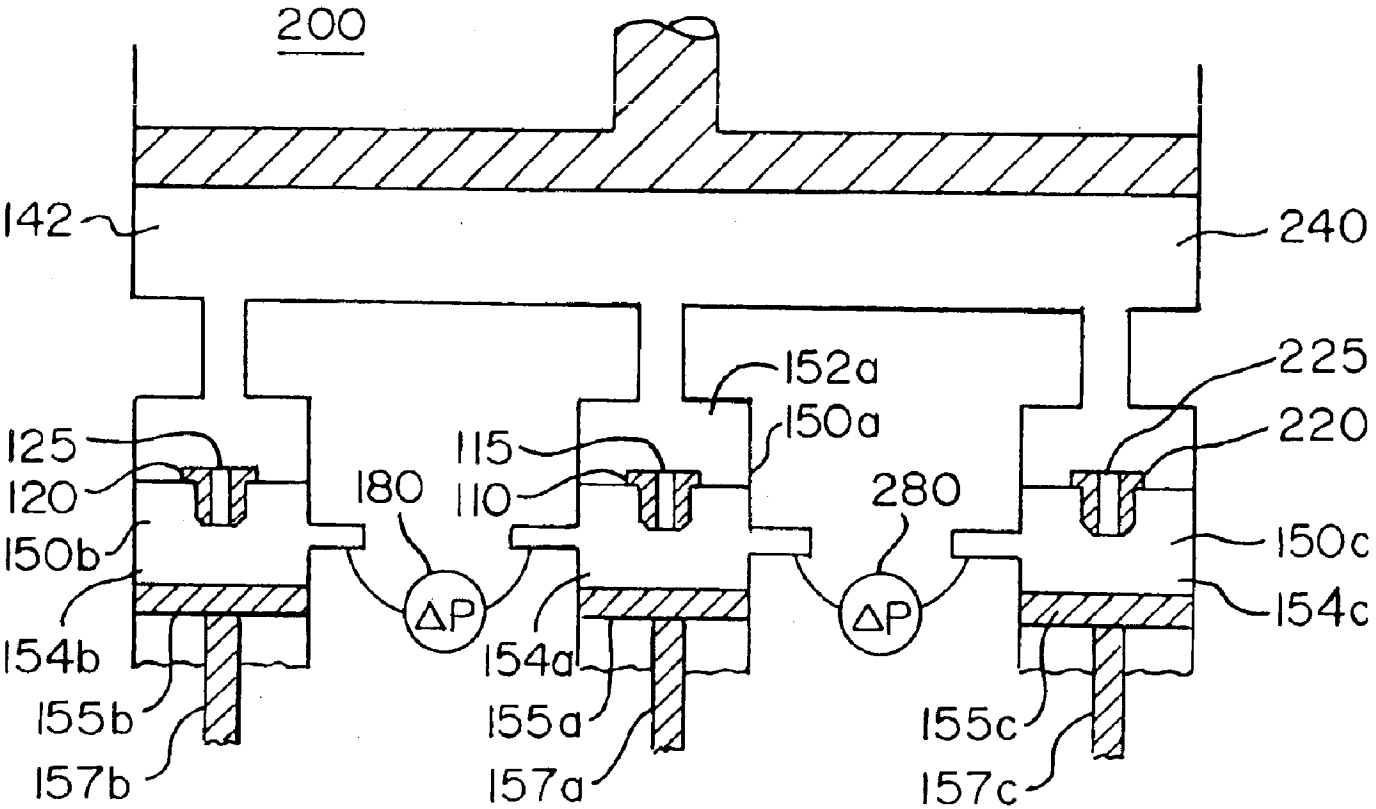
FIG. 5 is a schematic view of another embodiment invention whereby multiple workpiece orifices may be simultaneously measured with respect to a common master orifice.

With reference to FIGS. 3–5 and for convenience, since the hardware associated with controlled flow of the fluid through each orifice is identical, those identical parts will be identified with a common reference number, but distinguished using a different letter suffix. Those parts associated with the master part 110 will have an "a" suffix, while those parts associated with the fluid flow through the workpiece 120 will have a "b" suffix. As will be subsequently described, additional workpieces will also utilize different letter suffixes.

Directing attention to FIG. 3, the master part 110 is removably mounted within a receiving cylinder 150*a*. The receiving cylinder 150*a* is in direct fluid communication with the reservoir 140. Fluid 142 enters the receiving cylinder 150*a* at an upstream chamber 152*a* and passes through the orifice 115 into a downstream chamber 154*a*. The fluid is not permitted to exit to the atmosphere, but instead a retracting piston 155*a* determines the flow with which the fluid passes through the orifice 115. In particular, the fluid 142 may pass through the orifice 115 at a rate determined solely by the retraction rate of the piston 155*a*. The retraction rate of the piston 155*a* will be designed to accommodate the fluid 142 flow and is not intended to create cavitation within the downstream chamber 154*a*.

In the same fashion, the workpiece 120 is removably secured within the receiving cylinder 150*b*. The receiving cylinder 150*b* is in direct communication with the reservoir 140. Fluid 142 enters the receiving cylinder 150*b* at an upstream chamber 152*b* and passes through the orifice 115 into a downstream chamber 154*b*. The fluid is not permitted to exit to the atmosphere, but instead a retracting piston 155*b* determines the flow with which the fluid passes through the orifice 115. In particular, the fluid 142 may pass through the orifice 115 at a rate determined solely by the retraction rate of the piston 155*b*. The retraction rate of the piston 155*b* will be designed to accommodate the fluid 142 flow and is not intended to create cavitation within the downstream chamber 154*b*.

Since the flow rate of the fluid 142 through the master orifice 115 and the workpiece 125 should be identical, and since each of the retracting pistons 155*a*, 155*b* determine the fluid flow rate through each of the orifices 115, 125, then it is important that the retraction of each of the retraction pistons 155*a*, 155*b*, be such that this fluid flow is equal. Inasmuch as the dimensions of the receiving cylinder 150*a* and receiving cylinder 150*b* are identical, then the rate of retraction for each of the retracting pistons 155*a*, 155*b*, must be identical. This goal is possible by mechanically coupling each retracting piston 155*a*, 155*b* with the other using, for example, a flow controller 160 which may be comprised of, for example, a motor coupled with a ball screw or similar device for translating the rotary motion of a motor to the linear motion of the retracting piston 155*a*, 155*b*. This constant flow rate may be easily achieved by simply rigidly connecting each of the retracting pistons 155*a*, 155*b* together. For example, each piston rod 157*a*, 157*b*, associated with the retracting pistons 155*a*, 155*b*, may be attached to a common platen 162, which in turn is driven by the described motor/ball screw arrangement.

A measurement device 180 compares the pressure downstream at the outlet of the master orifice 115 and the pressure downstream at the outlet of the workpiece orifice 125 to determine the pressure differential downstream of each of these orifices. If the pressure is within predetermined limits, then the workpiece 125 is deemed to be within tolerance of the master orifice 115.

The workpiece orifice 125 is originally formed to resemble as closely as possible, using existing mass production facilities, the master orifice 115.

Although not illustrated in FIG. 2, it is entirely possible that the retracting piston 155*b* associated with the workpiece orifice 125 is independently movable by a central operator (not shown) capable of moving the retracting piston 155*b* in unity with the retracting piston 155*a* associated with the master orifice 115. As will be discussed, in an alternate embodiment of the subject invention, the fluid may contain abrasive particles that actually polish the surface of each orifice and, under such circumstances, the central operator would be capable of moving one or more selected retracting pistons in unity with the retracting piston 155*a* associated with the master part while retaining other retracting pistons in a stationary position to selectively polish some orifices.

In order to determine the pressure difference within the receiving cylinders downstream of each orifice, the measurement device 180 may be a pressure gauge whereby the values disclosed within the pressure gauge are compared to determine the pressure differential. On the other hand, the measurement device 180 may be comprised of a pressure comparator fluidly connected to the downstream chamber 154*a* of the receiving cylinder 150*a* and the downstream chamber 154*b* of the receiving cylinder 150*b*.

For the sole determination of whether or not the workpiece orifice 125 is within tolerance of the master orifice 115, the fluid may be a flowable, non-abrasive media such as a low viscosity calibration fluid. However, in the event the workpiece orifice 125 is not within tolerance of the master orifice 115, but may be with additional metal removal by polishing, it is possible to substitute the flowable, non-abrasive media with a flowable, abrasive media, such that motion of the abrasive media across the orifice will remove material from the orifice until the difference between the downstream pressure of the master orifice 115 and workpiece orifice 125 is a predetermined value or less. In the event the fluid is a flowable, abrasive media, then it is imperative that the master part 110 be made of a material that is impervious to, and unaffected by, the abrasive flow media.

Utilizing a flowable, abrasive media, it is possible to monitor the pressure difference in the downstream chambers 154*a*, 154*b*, and if the pressure difference is between predetermined limits, to terminate the flow of the abrasive media to the workpiece orifice 125. In the event, however, it is determined that the pressure drop through the workpiece orifice 125 is more than the pressure drop through the master orifice 115 such that additional material removal within the workpiece orifice 125 is desirable, then the flow of abrasive media may continue through the workpiece orifice 125 and the pressure difference monitored until such time as the downstream pressure between the master orifice 115 and the workpiece orifice 125 is between the predetermined limits.

What has been described so far is an apparatus for comparing the flow rate through at least one orifice of at least one workpiece formed to resemble a master orifice and a master part against the flow rate through the master orifice, to determine whether or not the workpiece flow rate is within tolerance relative to the master orifice.

A method for utilizing such an apparatus is comprised of the steps of forcing fluid 142 from the reservoir 140 under pressure through the master orifice 115. Additionally, the same fluid 142 is forced from the same reservoir 140 under the same pressure through the at least one workpiece orifice 125. The flow of fluid 142 is controlled to provide an equal volumetric or mass flow rate through each of the at least one workpiece orifices 125, and the master orifice 115. The fluid pressure downstream of the orifices is compared to determine whether or not the pressure differential is between predetermined limits indicating whether or not the flow rate of the at least one workpiece orifice is within tolerance. Inasmuch as this method is utilized only to determine whether or not the workpiece orifice is within tolerance of the master orifice, then the fluid may be non-abrasive. However, the fluid 142 may be a flowable abrasive media, wherein the material of the master part 110 is impervious to and unaffected by the flowable abrasive media, and wherein the step of forcing fluid 142 through the at least one workpiece orifice 125 includes the step of machining with fluid 142 comprised of flowable, abrasive media the at least one workpiece orifice 125 to polish the orifice 125, thereby reducing the pressure drop past the orifice 125. Under these circumstances, the flow of fluid 142 past that workpiece orifice 125 is terminated when the difference between the pressure downstream of the workpiece orifice 125 and downstream of the master orifice 115 is within predetermined limits.

As a general guideline, the step of stopping the extrusion may occur when the pressure differential between the pressure downstream of the master orifice 115 and of the workpiece orifice 125 is 35–40 psig or less. An appropriate pressure differential may be determined based upon the desired tolerance.

FIG. 4 is a cross-sectional view of an embodiment of the subject invention which is illustrated schematically in FIG. 3. Since the operation of this apparatus has already been described in detail, only a brief description will be presented to identify the key elements of this apparatus utilizing identical reference numbers as found in FIG. 3.

FIG. 4 illustrates a master part 110 having a master orifice 115 extending therethrough. The master part 110 is removably mounted within a receiving cylinder 150*a* having an upstream chamber 152*a*, in which the fluid 142 is introduced and a downstream chamber 154*a* into which the fluid enters after passing through the orifice 115. A retracting piston 155*a* determines the flow with which the fluid 142 passes through the orifice 115.

In the same fashion, the workpiece 120 having a workpiece orifice 125 is removably secured within the receiving cylinder 150*b*. The receiving cylinder 150*b* is in direct communication with a reservoir (not shown). Fluid 142 enters the receiving cylinder 150*b* at the upstream chamber 152*b* and passes through the orifice 115 into a downstream chamber 154*b*. A retracting piston 155*b* determines the flow with which the fluid passes through the orifice 115. The retracting pistons 155*a*, 155*b* may be mechanically coupled with each other using, for example, a flow controller (not shown) which as previously mentioned may be comprised of a motor coupled with a ball screw or similar device for translating the rotary motion of a motor to the linear motion of the retracting pistons 155*a*, 155*b*. Each piston rod 157*a*, 157*b* associated with the retracting pistons 155*a*, 155*b* may be attached to a common platen (not shown) which in turn is driven by the described motor/ball screw arrangement.

A measurement device 180 compares the pressure downstream of the master orifice 115 and the pressure downstream of the workpiece orifice 125 to determine the pressure differential downstream of each of these orifices. If the pressure is between predetermined limits, then the workpiece 125 is deemed to be within tolerance of the master orifice 115. It should be noted that the length and diameter of the passageways 165*a*, 165*b* from the reservoir (not shown) to the receiving cylinder 150*a*, 150*b* are identical so that the properties of the fluid 142 entering each of the upstream chambers 152*a*, 152*b* are identical.

So far described are a method and apparatus in a first embodiment for comparing the pressure downstream of a workpiece orifice 125 with the pressure downstream of a master orifice 115 and, in a second embodiment, machining with an abrasive fluid, the workpiece orifice 125 until it is within tolerance of the master orifice 115.

It is also possible to simultaneously test a plurality of workpiece orifices utilizing a single master orifice to determine whether or not each of these orifices is within tolerance.

Directing attention to FIG. 5, fluid 142 within a reservoir 240 is in direct communication with the receiving cylinder 150*a* associated with a master part 110 having a master orifice 115. The receiving cylinder 150*a*, just as previously discussed, includes an upstream chamber 152*a*, and a downstream chamber 154*a* with the master part 110 removably secured therebetween within the receiving cylinder 150*a*. A similar arrangement exists for a workpiece 120 having a workpiece orifice 125 mounted within a receiving cylinder 150*b*, and for a workpiece 220 having a workpiece orifice 225 mounted within a receiving cylinder 150*c*. Each retracting piston 155*a*, 155*b*, 155*c* is capable of being retracted within its respective receiving cylinder 150*a*, 150*b*, 150*c* at a uniform rate such that the flow of fluid 142 through each of the orifices 115, 125, 225 is equal. A measurement device 180 measures the difference in pressure between fluid 142 in the downstream chamber 154*a*, and the pressure of fluid 142 within the downstream chamber 154*b*. Additionally, a measurement device 280 measures the difference in pressure between the fluid 142 within the downstream chamber 154*a* of the receiving cylinder 150*a*, and the downstream chamber 154*c* of the receiving cylinder 150*c*. In this manner, two workpiece orifices 125, 225 may be measured simultaneously to determine whether or not they are within tolerance of the master orifice 115. Under these circumstances, the retraction rate of the retracting pistons 155*a*, 155*b*, 155*c* may be identical, and the fluid 142 may be a non-abrasive media.

In the event the pressure difference of the fluid in the downstream chamber 154*a*, and of the fluid in the downstream chamber 154*c* indicates that a workpiece orifice 125, 225 is restricted, then in an alternate embodiment of the invention, the non-abrasive fluid 142 may be substituted with abrasive fluid such as a flowable abrasive media. Under these circumstances, as previously mentioned, the master part 110 must be impervious to the flowable abrasive media, and the flowable abrasive media may pass through the workpiece orifices 125, 225 until the restriction is removed and the pressure difference downstream of the orifices 115, 225 as measured by the measurement device 280 is within predetermined limits.

Under circumstances whereby a plurality of workpieces are mounted within the apparatus 200, and one or more of the workpieces have orifices with restrictions that indicate they are out of tolerance with the master orifice 115, then the flow controller may selectively control the motion of one or more of the retracting pistons 155*b, c*, such that there is flow at the same rate as flow through the master orifice or there is no flow. As an example, if both the workpiece orifice 125 and the workpiece orifice 225 have restrictions smaller than the master orifice 110 restriction which cause them to be out of tolerance with the master orifice 115, then abrasive fluid 142 may be passed through each of these orifices 125, 225 and the pressure difference with the downstream pressure of the master orifice 115 monitored. In the event the pressure downstream of the orifice 125 is within a predetermined range of the pressure downstream of the master orifice 115, then the retraction of the retracting piston 155*a* may cease and the retraction of the retracting piston 155*c* may continue while the orifice 225 is further machined. Such a process may continue until the difference between the downstream pressure at the workpiece orifice 225 and the downstream pressure of the master orifice 115 are within a predetermined range.

The device as it has so far been described is a comparator which gives the relative pressure difference for flow through the orifices of two or more tested parts. The device does not, on its own, quantify the flow rate through the workpiece orifice. There is no need to quantify the flow rate when it is only necessary to know if a workpiece orifice is within tolerance relative to a master orifice. However, when the workpiece orifice is out of tolerance, then it is helpful to know the flow rate through the one or more orifices of the workpiece under given conditions to make a determination of whether or not the workpiece may be reworked or must be scrapped. Additionally, there are some occasions when the true flow rate value is required, such as during process setup or special testing.

Since the apparatus in accordance with the subject invention will determine how much the flow through the one or more orifices of a workpiece differs relative to the flow through the one or more matching orifices of a master part, it is only necessary to know the flow rate of the master part, and the flow rate through the workpiece can be determined.

In particular, equations for the theoretical flow rate of a fluid through an orifice are well established and may be found in textbooks on the subject of fluid mechanics. If one considers the same flow of fluid through two parts subjected to uniform upstream pressure, it is possible to one skilled in the art to derive a theoretical relationship between the (true) flow rate of the unknown part (B in the example below) to the (true) flow rate of the known part (A below), the fluid properties, the flow rate of fluid in the described device, the differential pressure from the device, and the pressure drop at which the true flow rate of A was measured. Such a relationship is described in the following equation.

$$QB(\Delta P_{pms}, \Delta P_{fb}, Q, QA, \rho_{pms}, \rho_{fb}) := \frac{\sqrt{Q^2 \cdot \rho_{pms}^2 \cdot \Delta P_{fb}^2 - \Delta P_{pms} \cdot \Delta P_{fb} \cdot \rho_{fb} \cdot \rho_{pms} \cdot QA^2} \cdot (QA \cdot Q)}{Q^2 \cdot \rho_{pms} \cdot \Delta P_{fb} - \Delta P_{pms} \cdot \rho_{fb} \cdot QA^2} \quad \text{Eq.}$$

Where

QA is the true flow rate of part A measured on a standard flow bench under the following conditions:

$\Delta P_{fb}$ is the pressure drop across the orifice $\rho_{fb}$ is the density of the fluid in the standard flow bench QB is the flow rate of part B (if it were measured with the same fluid and pressure drop as QA)

$\Delta P_{pms}$ is the differential pressure of the receive cylinders of the invention $\rho_{pms}$ is the density of the fluid in described device Q is the flow rate through the parts in the described device.

This formula is based on theoretical flow through an orifice, but the actual flow is typically lower than the theoretical flow due to the effects of entrance geometry, surface roughness, etc. In light of this, the form of the relationship stated in the equation found above remains the same but coefficients must be introduced to accommodate the differences between theoretical and actual values. The coefficients C1, C2, C3, and C4, can be determined experimentally. This equation is applicable whether the pressure upstream of each orifice or downstream of each orifice is measured.

What has so far been discussed is a constant flow rate established upstream and a comparison of the downstream pressure at the workpiece and at the master part. However, it should be appreciated that, while maintaining a uniform downstream pressure, a comparison of the upstream pressure may also be used as an indicator.

Figure 6:
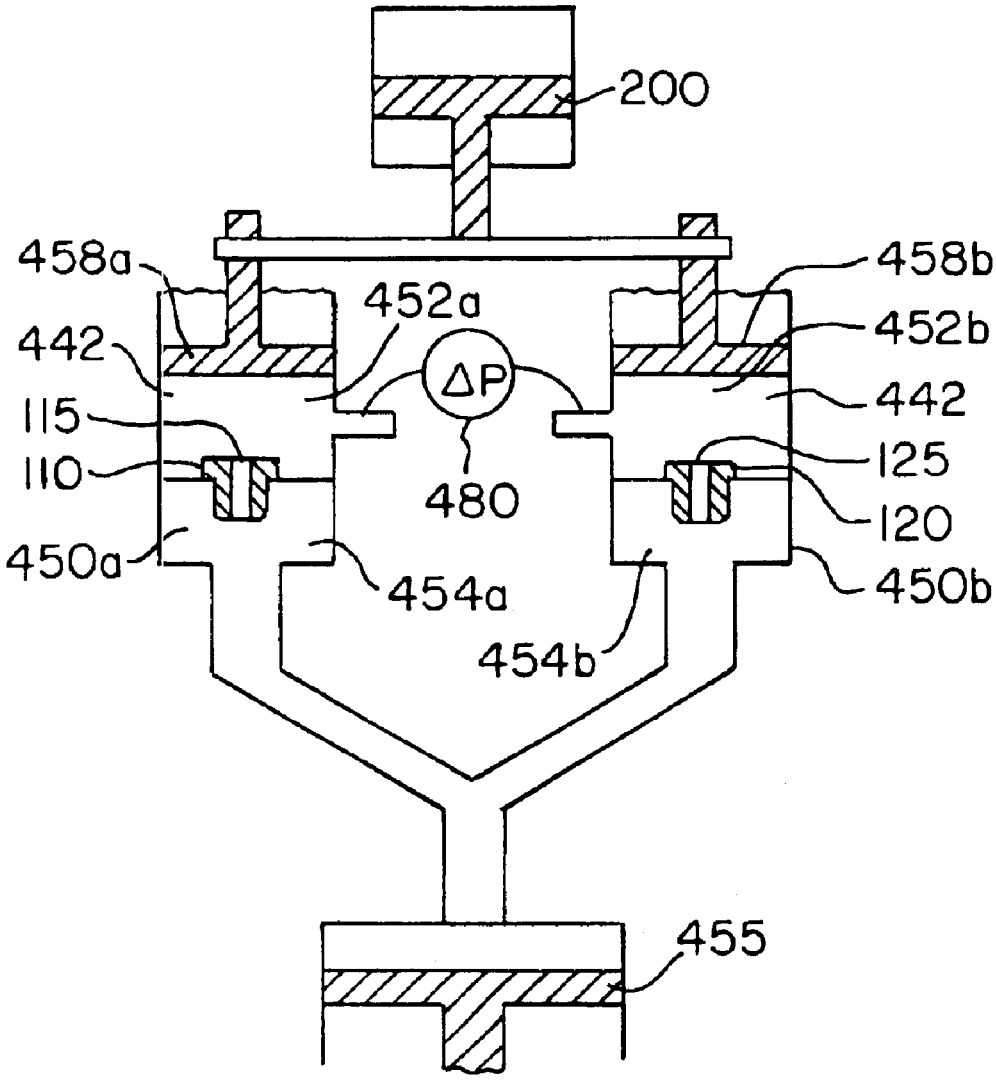
FIG. 6 is a schematic drawing of another embodiment of an apparatus in accordance with the subject invention.

With reference to FIG. 6 and, for convenience, since the hardware associated with controlled flow of the fluid through each orifice is identical, those identical parts will be identified with a common reference number, but distinguished using a different letter suffix. Those parts associated with the master part 110 will have an "a" suffix, while those parts associated with the fluid flow through the workpiece 120 will have a "b" suffix. As will be subsequently described, additional workpieces will also utilize different letter suffixes.

Directing attention to FIG. 6, the master part 110 is removably mounted within a receiving cylinder 450*a*. Fluid 442 in the receiving cylinder 450*a* in an upstream chamber 452*a* passes through the orifice 115 into a downstream chamber 454*a*. The fluid may be permitted to exit to the atmosphere, or as illustrated in FIG. 6, is opposed by a retracting piston 455, thereby producing back pressure downstream of the master part 110. The flow through the orifice 115 is determined by the rate of the advancing piston 458*a*. In particular, the fluid 442 may pass through the orifice 115 at a rate determined solely by the advancement rate of the piston 458*a*. The retraction rate of the piston 455 will be designed to accommodate the fluid 442 flow and is not intended to create cavitation within the downstream chamber 454*a*.

In the same fashion, the workpiece 120 is removably secured within the receiving cylinder 450*b*. Fluid 442 in the receiving cylinder 450*b* at an upstream chamber 452*b* passes through the orifice 125 into a downstream chamber 454*b*. The fluid may be permitted to exit to the atmosphere, or as illustrated in FIG. 6, is opposed by the retracting piston 455, thereby producing back pressure downstream of the workpiece 120. The downstream pressure at the master part 110 should be the same as that downstream pressure at the workpiece 100. The flow through the orifice 125 is determined by the rate of the advancing piston 458*b*. In particular, the fluid 442 may pass through the orifice 125 at a rate determined solely by the advancement rate of the piston 48*b*. Again, the retraction rate of the piston 455*a* will be designed to accommodate the fluid 442 flow and is not intended to create cavitation within the downstream chamber 454*b*.

Since the flow rate of the fluid 442 through the master orifice 115 and the workpiece 125 should be identical, and since each of the advancing pistons 458*a*, 458*b* determine the fluid flow rate through each of the orifices 115, 125, then it is important that the advancement of each of the advancing pistons 458*a*, 458*b*, be such that this fluid flow through each orifice is equal.

Inasmuch as the dimensions of the receiving cylinder 450*a* and receiving cylinder 450*b* are identical, then the rate of advancement for each of the advancing pistons 458*a*, 458*b*, must be identical. This goal is possible by mechanically coupling each advancing piston 458*a*, 458*b* with the other using, for example, by mechanisms previously discussed relative to controlling the retracting pistons 155*a*, 155*b*.

A measurement device 480 compares the pressure upstream at the inlet of the master orifice 115 and the pressure upstream at the inlet of the workpiece orifice 125 to determine the pressure differential upstream of each of these orifices. If the pressure is within predetermined limits, then the workpiece 125 is deemed to be within tolerance of the master orifice 115.

The workpiece orifice 125 is originally formed to resemble as closely as possible, using existing mass production facilities, the master orifice 115.

Although not illustrated in FIG. 6, it is entirely possible that the advancing piston 458*b* associated with the workpiece orifice 125 is independently movable by a central operator (not shown) capable of moving the advancing piston 458*b* in unison with the advancing piston 458*a* associated with the master orifice 115. As previously discussed, in an alternate embodiment of the subject invention, the fluid may contain abrasive particles that actually polish the surface of each orifice and, under such circumstances, the central operator would be capable of moving one or more selected advancing pistons in unity with the advancing piston 458*a* associated with the master part while retaining other advancing pistons in a stationary position to selectively polish some orifices.

In order to determine the pressure difference within the receiving cylinders upstream of each orifice, the measurement device 480 may be a pressure gauge whereby the values disclosed within the pressure gauge are compared to determine the pressure differential. On the other hand, the measurement device 480 may be comprised of a pressure comparator fluidly connected to the upstream chamber 452*a* of the receiving cylinder 450*a* and the upstream chamber 452*b* of the receiving cylinder 450*b*.

Utilizing a flowable, abrasive media, it is possible to monitor the pressure difference in the upstream chambers 452*a*, 452*b*, and if the pressure difference is between predetermined limits, to terminate the flow of the abrasive media to the workpiece orifice 125. In the event, however, it is determined that the pressure drop through the workpiece orifice 125 is more than the pressure drop through the master orifice 115 such that additional material removal within the workpiece orifice 125 is desirable, then the flow of abrasive media may continue through the workpiece orifice 125 and the pressure difference monitored until such time as the upstream pressure between the master orifice 115 and the workpiece orifice 125 is between the predetermined limits.

While specific embodiments of the invention have been described in detail, it will be appreciated by those skilled in the art that various modifications and alternatives to those details could be developed in light of the overall teachings of the disclosure. The presently preferred embodiments described herein are meant to be illustrative only and not limiting as to the scope of the invention which is to be given the full breadth of the appended claims and any and all equivalents thereof.

What is claimed is:

1. A method of comparing the flow rate through one or more orifices in a workpiece, wherein each workpiece orifice is formed to resemble an orifice in a master part and wherein the flow rate through the one or more workpiece orifices is compared against the flow rate through the matching one or more orifices in the master part to determine whether or not the flow rate through the one or more workpiece orifices is within tolerance relative to the flow rate through the one or more master orifices comprising the steps of:

a) forcing calibration fluid from a reservoir under pressure through the one or more orifices in the master part;

b) forcing calibration fluid from the same reservoir under the same pressure through the one or more orifices in the workpiece;

c) controlling the flow of fluid to provide an equal flow rate through the one or more orifices in the workpiece and the one or more orifices in the master part; and d) comparing the fluid pressure downstream of each the workpiece and the master part to determine whether or not the pressure differential is within predetermined limits indicating whether or not the flow rate through the one or more orifices in the workpiece are within tolerance.

2. The method according to claim 1, wherein the fluid is non-abrasive.

3. The method according to claim 1, wherein the one or more orifices in the workpiece define a workpiece outlet and the one or more orifices in the master part define a master part outlet and wherein the pressure differential is measured at the workpiece outlet and at the master part outlet.

4. The method according to claim 1, wherein the fluid is a flowable abrasive media and wherein the master part material is impervious to and unaffected by the flowable abrasive media and wherein the step of forcing the calibration fluid through the one or more workpiece orifices polishes the one or more workpiece orifices.

5. The method according to claim 4, further including, subsequent to the step of comparing the media pressure, the step of terminating the flow of abrasive media past the one or more workpiece orifices when the difference between the pressure downstream of the workpiece and downstream of the master part is equal to or less than a predetermined value.

6. A method of comparing the flow rate through one or more orifices in multiple workpieces formed to resemble one or more orifices in a master part with the flow rate through the one or more master part orifices to determine whether or not the flow rate through the one or more orifices in each of the multiple workpieces is within tolerance relative to the flow rate through the matching one or more master part orifices comprising the steps of:

a) forcing calibration fluid from a reservoir under pressure through the one or more orifices in the master part;

b) forcing calibration fluid from the same reservoir under the same pressure through the one or more orifices in each of the multiple workpieces;

c) controlling the flow of fluid to provide an equal flow rate through the one or more orifices in each of the multiple workpieces and the one or more orifices in the master part; and d) comparing the fluid pressure downstream of each of the multiple workpieces and master part to determine whether or not the pressure differential is within predetermined limits indicating whether or not the flow rate through the one or more orifices in each of the workpieces is within tolerance.

7. A method of comparing the flow rate through one or more orifices in a workpiece, wherein the one or more workpiece orifices are formed to resemble one or more orifices in a master part wherein the flow rate through the workpiece is compared with the flow rate through the master part to determine whether or not the flow rate through the one or more workpiece orifices is within tolerance relative to the flow rate through the one or more master part orifices and machining the one or more workpiece orifices using abrasive flow media comprising the steps of:

a) extruding flowable abrasive media from the a reservoir under pressure through the one or more orifices in the master part, wherein the master part material is impervious to and unaffected by the abrasive flow media;

b) extruding flowable abrasive media from a reservoir under pressure through the one or more orifices in the workpiece; wherein prior to the extrusion the one or more workpiece orifices restrict flow more than the one or more master part orifices;

c) controlling the flow of media to provide an equal flow rate through the one or more workpiece orifices and through the one or more master part orifices;

d) comparing the media pressure downstream of the workpiece and the master part; and e) stopping the extrusion through the one or more workpiece orifices when the pressure differential of the media exiting the one or more workpiece orifices and the media exiting the one or more master orifices is between predetermined limits.

8. The method according to claim 7, wherein the step of stopping the extrusion occurs when the pressure differential is 35–40 psig or less.

9. The method according to claim 7, wherein the one or more orifices in the workpiece form a workpiece outlet, the one or more orifices in the master part form a master part outlet and wherein the step of comparing the media pressure downstream of the workpiece and of the master part is done by measuring the pressure differential between the downstream pressures at the exit of the one or more master part orifices and the exit of the one or more workpiece orifices.

10. The method according to claim 7, wherein the step of comparing the media pressure downstream of the workpiece and the master part is done by measuring the pressure at the exit of the one or more master part orifices and at the exits of the workpiece one or more orifices and comparing these values.

11. A method of comparing to a master part the flow rate through one or more orifices in multiple workpieces, wherein the one or more orifices in each workpiece are formed to resemble one or more orifices in the master part and wherein the flow rate through the one or more orifices in the multiple workpieces is compared with the flow rate through the one or more master part orifices to determine whether or not the flow rate through the one or more orifices in each workpiece is within tolerance relative to the flow rate through the one or more master part orifices and thereafter machining the one or more workpiece orifices using abrasive flow media comprising the steps of:

a) extruding flowable abrasive media from the a reservoir under pressure through the one or more orifices in the master part, wherein the master part material is impervious to and unaffected by the abrasive flow media;

b) extruding flowable abrasive media from a reservoir under the same pressure through the one or more orifices in each workpiece, wherein prior to the extrusion the one or more orifices in each workpiece restrict flow more than the one or more orifices in the master part;

c) controlling the flow of media to provide an equal flow rate through each of the workpieces and through the master part;

d) comparing the media pressure downstream of each of the workpieces with the pressure downstream of the master part; and e) stopping the extrusion through any workpieces when the differential between the pressure downstream of any of the workpieces and the pressure downstream of the master part is within predetermined limits.

12. An apparatus for comparing the flow rate through one or more orifices in a workpiece with the flow rate through one or more orifices in a master part, wherein the one or more workpiece orifices are formed to resemble one or more orifices in the master part, wherein the flow rate is compared to determine whether or not the flow rate through the one or more orifices in the workpiece are within tolerance relative to the flow rate through the one or more orifices in the master part, wherein the apparatus is comprised of:

a) a reservoir for supplying calibration fluid under pressure to the one or more orifices in the master part and to the one or more orifices of the workpiece;

b) a flow controller associated with the workpiece and the master part such that the flow of fluid from the reservoir through the one or more orifices in each of the workpiece and the master part is equal;

c) a measurement device for comparing the pressure downstream of the master orifice and the pressure downstream of the workpiece, wherein when the pressure differential downstream of the workpiece and downstream of the master part is within a predetermined limit, the orifices in that workpiece are deemed to be within tolerance.

13. The apparatus according to claim 12, wherein the flow controller associated with the workpiece and the master part is a receiving cylinder downstream of each the workpiece and master part and is a retractable piston within each cylinder that limits and thereby controls the flow of fluid through the one or more orifice of the workpiece and the master part.

14. The apparatus according to claim 13, wherein each retractable piston is coupled to another retractable piston such that the controlled flow through each of the workpiece and the master part is equal.

15. The apparatus according to claim 13, wherein each retractable piston is independently movable by a central operator capable of moving all pistons in unity with the master part piston or capable of moving select pistons in unity with the master part piston and keeping other pistons stationary.

16. The apparatus according to claim 12, wherein the measurement device is a pressure gauge downstream of each of the workpiece and the master part.

17. The apparatus according to claim 12, wherein the measurement device is a pressure comparator downstream of each of the workpiece and the master part.

18. The apparatus according to claim 12, wherein the fluid is a flowable non-abrasive media.

19. The apparatus according to claim 12, wherein the fluid is a flowable abrasive media and wherein the master part material is impervious to and unaffected by the abrasive flow media.

20. A method of determining the flow rate through a workpiece having one or more orifices formed to resemble one or more orifices in a master part comprising the steps of:

a) forcing calibration fluid from a reservoir under pressure through the one or more orifices in the master part;

b) forcing calibration fluid from the same reservoir under the same pressure through the one or more orifices in the workpiece;

c) controlling the flow of fluid to provide an equal flow rate through each of the workpiece and the master part;

d) comparing the media pressure downstream of the master part and the workpiece to determine a pressure difference; and e) calculating the flow rate through the workpiece using predetermined flow rate data about the master part, the difference in downstream pressure between the workpiece and the master part, and the mathematical relationship between the orifices in the master part and the orifices in the workpiece.

21. The method according to claim 20, wherein the one or more orifices in the workpiece form a workpiece outlet, the one or more orifices in the master part form a master part outlet and wherein the pressure differential is measured at the outlet of the master part and at the outlet of the at least one workpiece.

22. The method according to claim 20, wherein the predetermined flow rate data about the master part is provided by testing the master part using a flow bench.

23. A method of comparing the flow rate through one or more orifices in a workpiece, wherein each workpiece orifice is formed to resemble an orifice in a master part and wherein the flow rate through the one or more workpiece orifices is compared against the flow rate through the matching one or more orifices in the master part to determine whether or not the flow rate through the one or more workpiece orifices is within tolerance relative to the flow rate through the one or more master orifices comprising the steps of:

a) forcing calibration fluid under a pressure through the one or more orifices in the master part;

b) forcing calibration fluid under a pressure through the one or more orifices in the workpiece;

c) controlling the flow of fluid to provide an equal flow rate through the one or more orifices in the workpiece and the one or more orifices in the master part;

d) maintaining a uniform pressure downstream of each the master part and the workpiece; and e) comparing the fluid pressure upstream of each the workpiece and the master part to determine whether or not the pressure differential is within predetermined limits indicating whether or not the flow rate through the one or more orifices in the workpiece are within tolerance.

24. A method of comparing the flow rate through one or more orifices in multiple workpieces formed to resemble one or more orifices in a master part with the flow rate through the one or more master part orifices to determine whether or not the flow rate through the one or more orifices in each of the multiple workpieces is within tolerance relative to the flow rate through the matching one or more master part orifices comprising the steps of:

a) forcing calibration under pressure through the one or more orifices in the master part;

b) forcing calibration fluid under pressure through the one or more orifices in each of the multiple workpieces;

c) controlling the flow of fluid to provide an equal flow rate through the one or more orifices in each of the multiple workpieces and the one or more orifices in the master part;

d) maintaining a uniform pressure downstream of each the master part and the workpiece; and e) comparing the fluid pressure upstream of each of the multiple workpieces and master part to determine whether or not the pressure differential is within predetermined limits indicating whether or not the flow rate through the one or more orifices in each of the workpieces is within tolerance.

25. A method of comparing the flow rate through one or more orifices in a workpiece, wherein the one or more workpiece orifices are formed to resemble one or more orifices in a master part wherein the flow rate through the workpiece is compared with the flow rate through the master part to determine whether or not the flow rate through the one or more workpiece orifices is within tolerance relative to the flow rate through the one or more master part orifices and machining the one or more workpiece orifices using abrasive flow media comprising the steps of:

a) extruding flowable abrasive media under pressure through the one or more orifices in the master part, wherein the master part material is impervious to and unaffected by the abrasive flow media;

b) extruding flowable abrasive media under pressure through the one or more orifices in the workpiece; wherein prior to the extrusion the one or more workpiece orifices restrict flow more than the one or more master part orifices;

c) controlling the flow of media to provide an equal flow rate through the one or more workpiece orifices and through the one or more master part orifices;

d) maintaining a uniform pressure downstream of each the master part and the workpiece;

e) comparing the media pressure upstream of the workpiece and the master part; and f) stopping the extrusion through the one or more workpiece orifices when the pressure differential of the media exiting the one or more workpiece orifices and the media exiting the one or more master orifices is between predetermined limits.

26. An apparatus for comparing the flow rate through one or more orifices in a workpiece with the flow rate through one or more orifices in a master part, wherein the one or more workpiece orifices are formed to resemble one or more orifices in the master part, wherein the flow rate is compared to determine whether or not the flow rate through the one or more orifices in the workpiece are within tolerance relative to the flow rate through the one or more orifices in the master part, wherein the apparatus is comprised of:

a) a receiving cylinder for supplying calibration fluid under pressure to each of the one or more orifices in the master part and to the one or more orifices of the workpiece;

b) a flow controller associated with the workpiece and the master part such that the flow of fluid from each receiving cylinder through the one or more orifices in each of the workpiece and the master part is equal;

c) a means of controlling the pressures downstream of the master part and the workpiece so that the two pressures are uniform;

d) a measurement device for comparing the pressure upstream of the master orifice and the pressure upstream of the workpiece, wherein when the pressure differential upstream of the workpiece and upstream of the master part is within a predetermined limit, the orifices in that workpiece are deemed to be within tolerance.

* * * * *